US010208634B2

(12) United States Patent
Xu

(10) Patent No.: US 10,208,634 B2
(45) Date of Patent: Feb. 19, 2019

(54) COLUMNAR HYDRAULIC TAPPET

(71) Applicant: HANGZHOU XZB TECH CO., LTD, Zhejiang (CN)

(72) Inventor: Na Xu, Zhejiang (CN)

(73) Assignee: HANGZHOU XZB TECH CO., LTD, Hangzhou, Zhejiang (CN)

( * ) Notice: Subject to any disclaimer, the term of this patent is extended or adjusted under 35 U.S.C. 154(b) by 0 days.

(21) Appl. No.: 15/542,391

(22) PCT Filed: Jan. 5, 2016

(86) PCT No.: PCT/CN2016/070125

§ 371 (c)(1),
(2) Date: Jul. 7, 2017

(87) PCT Pub. No.: WO2016/091224

PCT Pub. Date: Jun. 16, 2016

(65) Prior Publication Data

US 2017/0342867 A1 Nov. 30, 2017

(30) Foreign Application Priority Data

Dec. 11, 2014 (CN) ..... 2014 1 0765784

(51) Int. Cl.
*F01L 1/14* (2006.01)
*F01L 1/245* (2006.01)
*F01L 1/24* (2006.01)

(52) U.S. Cl.
CPC ..... *F01L 1/245* (2013.01); *F01L 1/24* (2013.01); *F01L 1/2405* (2013.01); *F01L 2103/00* (2013.01)

(58) Field of Classification Search
CPC . F01L 1/24; F01L 1/2405; F01L 1/245; F01L 2103/00

(Continued)

(56) References Cited

U.S. PATENT DOCUMENTS 9,869,212 B2 * 1/2018 Xu ..... F01L 1/16 123/90.45
2008/0271694 A1 11/2008 Brothers

FOREIGN PATENT DOCUMENTS

CN 201228569 4/2009
CN 102022948 A 4/2011

(Continued)

OTHER PUBLICATIONS

International Search Report & Written Opinion dated Mar. 31, 2016 from corresponding International PCT Application No. PCT/CN2016/070125.

*Primary Examiner* — Ching Chang
(74) *Attorney, Agent, or Firm* — Innovation Capital Law Group, LLP; Vic Lin

(57) ABSTRACT

A columnar-type hydraulic tappet, provided with a housing, a plunger moving axially with respect to the housing being mounted in an inner cavity of the housing, a high pressure cavity used for a hydraulic medium extending between a lower end surface of the plunger and a lower side of the housing, a first ring groove being arranged below a head portion of the plunger, a second ring groove being arranged at a central portion of the plunger, a plunger central wall being between the first ring groove and the second ring groove, the second ring groove being a concave wide ring groove, wherein at least one plunger oil inlet hole being arranged on the plunger concave wide ring groove or the plunger central wall, a bottom portion edge of the plunger oil inlet hole containing flanging facing towards an inner cavity of the plunger.

5 Claims, 6 Drawing Sheets

(58) Field of Classification Search
USPC ..... 123/90.48, 90.52, 90.55
See application file for complete search history.

(56) References Cited

FOREIGN PATENT DOCUMENTS

| | | | |
|---|---|---|---|
| CN | 102767405 | A | 11/2012 |
| CN | 103939162 | A | 7/2014 |
| CN | 203783666 | U | 8/2014 |
| CN | 104131852 | A | 11/2014 |
| CN | 204152577 | U | 2/2015 |
| CN | 204299641 | U | 4/2015 |
| CN | 104612776 | A | 5/2015 |
| CN | 204344185 | U | 5/2015 |
| EP | 2011974 | A1 | 1/2009 |

* cited by examiner

COLUMNAR HYDRAULIC TAPPET

FIELD OF THE INVENTION

The invention relates to the field of engine fitting manufacturing, and in particular, to a columnar-type hydraulic tappet capable of automatically compensating the valve clearance.

BACKGROUND

The uses of roller rocker and hydraulic tappet valve mechanism in the overhead cam engine structure are increasingly widespread, compared with the mechanical tappet valve mechanism, it has the following advantages: 1) compensate the valve clearance in a timely manner, requiring no periodical manual adjustment; 2) reduce the engine noise and shock; 3) small volume and weight, small friction and small kinematic inertia, which can reduce energy loss and improve engine efficiency; 4) Long life of the parts of valve mechanism, reducing the maintenance costs.

A columnar-type hydraulic tappet has a tank-shaped housing, provided with a tank-shaped housing, a plunger moving axially with respect to the housing being mounted in an inner cavity of the housing, a high pressure cavity used for a hydraulic medium extending between a lower end surface of the plunger and a lower side of the housing, the high pressure cavity being sealed by a unidirectional valve opened towards the high pressure cavity; a reset spring is arranged in the high pressure cavity, being between the lower end surface of the plunger and the housing. An oil hole used for hydraulic medium circulation is arranged at the housing, the oil hole is connected to an oil inlet hole of the plunger at a radial inner side of the housing, and an oil chamber used for storage of hydraulic medium is formed between the plunger oil inlet hole and the unidirectional valve.

The Chinese patent document CN102767405 discloses a hydraulic support member, which is a split structure composed of an upper plunger body and a lower plunger body. It has the advantages of low difficulty of processing for individual parts and proneness to remove the wastes producing from the cavity of the plunger; but its two parts are required to processing separately, which adds the machining processes, with low machinery efficiency and high production costs; especially it has high requirement of runout of the contact end surfaces of two plunger bodies. If the runout is poor, it may produce a lateral force and cause stuck of plunger body in the housing, which may restrict the uses of the product. In addition, if a punching process is adopted for a plunger oil inlet hole, sometimes the wastes cannot be completely punched to adhere to the inner wall, and there will be burrs if separated, affecting the product performance when falling in use; and if drilling and milling process are adopted, burrs may be left in the hole of inner wall, having risks.

The Chinese patent document CN201228569 discloses a hydraulic support member whose plunger is an integrated-type structure, with a steering member inside. Its drawback is that the processing of plunger cannot be completed at one time, requiring multiple processes, time and labor consuming. With such a structure of plunger oil inlet hole, wastes will inevitably generated when processing oil inlet holes. The plunger cavity of this kind of structure does not have a large outgoing channel, so the wastes produced cannot be removed completely. In addition, the wastes generating from hole processing may not be completely cut off but attached to the inner wall of the plunger, increasing the difficulty of waste removal.

SUMMARY

The object of the present invention is to provide an integral plunger-type column hydraulic tappet. The plunger is an integral structure, which is simple and firm, and the plunger oil inlet hole adopts a "semi-window opening"/"flanging" structure, i.e. at least one side of plunger oil inlet hole is not cut off, and the portion of flanging is connected together with the plunger, to solve the problem of being difficult to remove wastes within an integrated-type plunger.

In order to achieve the above object, the present invention employs the following technical solutions:

A columnar-type hydraulic tappet, provided with a housing, a plunger moving axially with respect to the housing being mounted in an inner cavity of the housing, a high pressure cavity used for a hydraulic medium extending between a lower end surface of the plunger and a lower side of the housing, the high pressure cavity being sealed by a unidirectional valve opened towards the high pressure cavity, an outer ring groove used for hydraulic medium circulation being arranged on the outer diameter of the housing, an inner ring groove used for hydraulic medium circulation being arranged at a radial inner side of the housing, one or a plurality of oil inlet holes being arranged between the inner ring groove and the outer ring groove, a first ring groove being arranged below a head portion of the plunger, a second ring groove being arranged at a central portion of the plunger, a plunger central wall being between the first ring groove and the second ring groove, the second ring groove being a concave wide ring groove, wherein at least one plunger oil inlet hole being arranged on the plunger concave wide ring groove or the plunger central wall, a bottom portion edge of the plunger oil inlet hole containing flanging facing towards an inner cavity of the plunger.

The flanging of the plunger oil inlet hole is a non-fractured window-opening structure, and a flanging that is naturally formed by the processing of plunger oil inlet hole is attached to the bottom of oil inlet hole of the inner cavity of the plunger.

The plunger oil inlet hole has a unilateral window opening, and the flanging is located on one side of the oil inlet hole of the plunger inner wall.

The plunger oil inlet hole has a bilateral window opening, and the flanging is located on both sides of the oil inlet hole of the plunger inner wall.

The plunger oil inlet hole is in a cone shape, and the flanging is surrounded in the entire circumferential direction of the oil inlet hole of the plunger inner wall.

Through studies, the inventor(s) has found that, when a plunger oil inlet hole is designed as a flanging structure, it can improve the processing technology and avoid the generation of wastes during hole processing, to solve the problem of being difficult to remove wastes within a closed cavity.

The plunger adopts the integral cold heading process, to form the plunger blank, then adopts the roll forming process to form a neck portion and a concave wide ring groove of the plunger, and finally adopts one-time forming process, to punch out a plunger oil inlet hole; the forming process is simple, with high processing efficiency.

A flanging that is naturally formed by the processing of plunger oil inlet hole is attached around the oil inlet hole of the inner cavity of the plunger, and the flanging is connected with the plunger body to form a whole.

Preferably, the plunger oil inlet hole is subjected to a punch forming process.

Preferably, the structure of the plunger oil inlet hole may be unilateral window opening, bilateral window opening, conical-hole window opening, etc.

Preferably, an opening direction of the plunger oil inlet hole may be a plurality of directions such as a longitudinal direction and a lateral direction, etc. One or a plurality of plunger oil inlet hole and oil grooves are distributed in the circumferential direction of the plunger; and when a plurality of oil inlet holes are provided, they may be arbitrarily arranged in the circumferential direction of the plunger as required.

Compared with the hydraulic tappets disclosed in the reference documents, the invention can achieve the following beneficial effects:

The plunger in the invention has an integrated structure, with high structure strength, simple processing and convenience for assembly. The plunger oil inlet hole adopts the flanging structure, which can improve the processing technology and avoid the generation of wastes during hole processing, to solve the problem of being difficult to remove wastes within a closed cavity.

The plunger in the invention has an integrated structure. Compared with the split-type plungers, the plunger herein has a simple structure, high structure strength and excellent processing technology, with low production costs; in addition, it is easy to assemble.

In the present invention, the plunger oil inlet hole is of a flanging structure, and the flanging portion formed by hole processing is attached to the periphery of the inner cavity of the plunger to form a whole. With the existing structure of plunger oil inlet hole, wastes will inevitably generated when processing holes. If drilling and milling process are adopted for hole processing, burrs may be left in the hole of inner walls and the iron powder processed are easily attached to the wall of inner cavity of the plunger; at this time it is required to remove the iron filings, which will increase the workload; in addition, it is not easy to remove the iron filings in the cavity. If a punching process is adopted for hole processing, the generated wastes are single waste blocks with large volume, or the wastes cannot be completely punched to adhere to the inner wall; when eliminating the wastes, the attached wastes may not be separated from the plunger body, and there will be burrs if separated, affecting the product performance when falling in use. In addition, if the plunger is an integral structure, there is no sufficiently large export on the plunger wall to eliminate waste blocks from the plunger cavity, greatly increasing the difficulty of waste removal from the inner cavity of the plunger.

Figure 1:
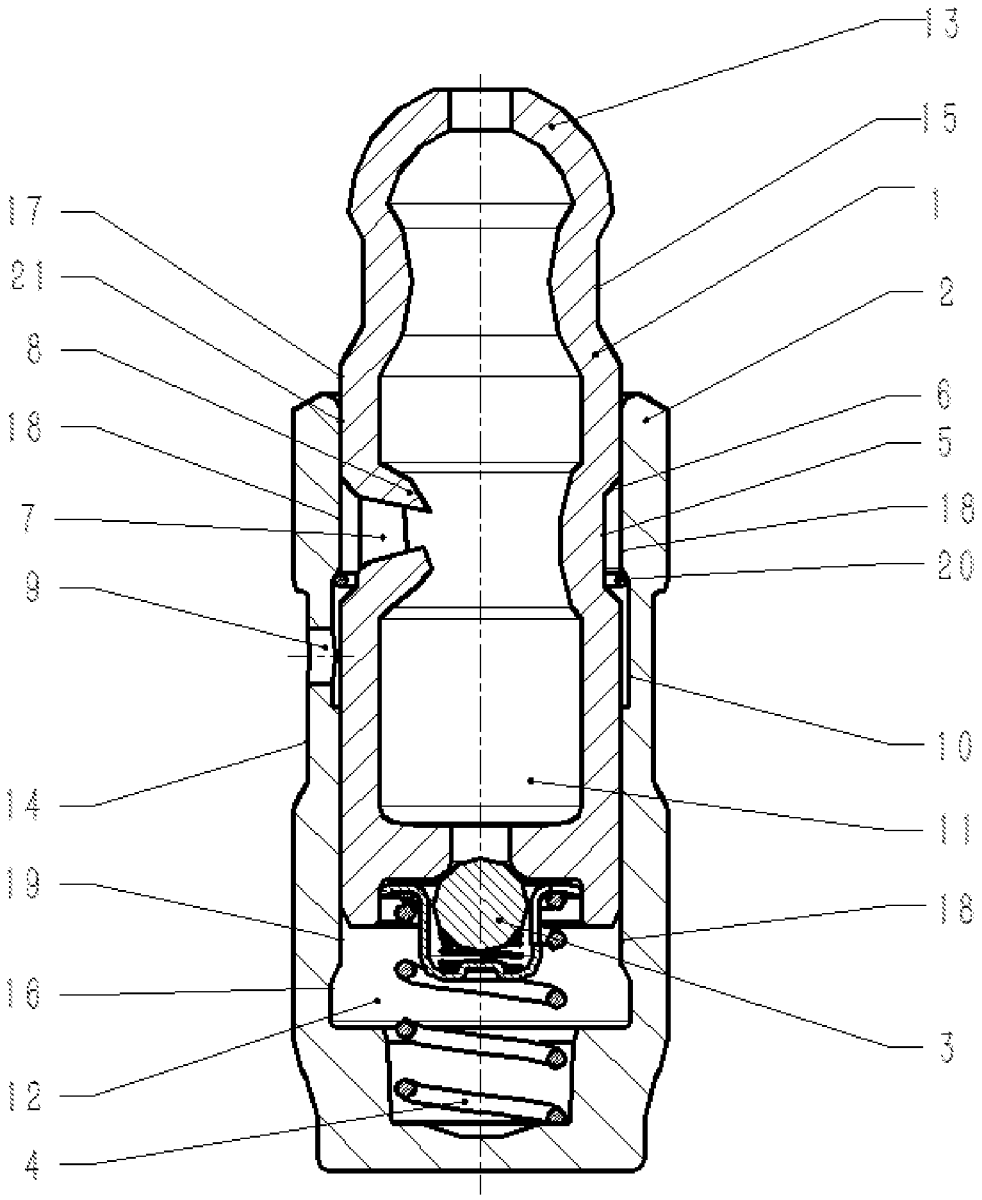
FIG. 1 is a schematic view of a hydraulic tappet according to the specific embodiment 1 of the present invention.

Notes:

1. Plunger
2. Housing
3. Unidirectional valve
4. Reset spring
5. Plunger concave wide ring groove
6. Upper conical surface of plunger ring groove
7. Plunger oil inlet hole
8. Flanging of plunger oil inlet hole
9. Oil hole of housing
10. Inner ring groove of housing
11. Oil chamber
12. High pressure cavity
13. Plunger head portion
14. Outer ring groove of housing
15. Plunger neck portion (first ring groove)
16. Grinding wheel groove of housing
17. Plunger upper wall
18. First inner cylindrical wall of housing
19. Second inner cylindrical wall of housing
20. Limit snap spring
21. Seal belt

DETAILED DESCRIPTION

The present invention is further described in combination with drawings.

EXAMPLE 1

Referring to FIG. 1, a columnar-type hydraulic tappet used for an engine valve mechanism, provided with a tank-shaped housing (2), a plunger (1) moving axially with respect to the housing being mounted in an inner cavity of the housing (2), a high pressure cavity (12) being between a lower end surface of the plunger (1) and the housing (2), the high pressure cavity (12) being sealed by a unidirectional valve (3) at the lower end of the plunger (1), and a reset spring (4) that connects the plunger (1) and the housing (2) being in the high pressure cavity (12). An outer ring groove of housing (14) used for hydraulic medium circulation being arranged on the outer diameter of the housing (2), an inner ring groove of housing (10) used for hydraulic medium circulation being arranged at a radial inner side of the housing, one or a plurality of oil holes (9) being arranged between the inner ring groove of housing (10) and the outer ring groove of housing (14), a first inner cylindrical wall of housing (18) being arranged at the upper inner wall of the inner ring groove of housing (10) and a second inner cylindrical wall of housing (19) being arranged at the lower inner wall of the inner ring groove of housing (10), a grinding wheel groove (16) used for blindhole processing being arranged at the lower end of the second inner cylindrical wall of housing (19). A concave wide ring groove (5) used for hydraulic medium circulation is arranged at the outer diameter of the plunger (1), the plunger wall above the concave wide ring groove (5) is a plunger upper wall (17), and the surface that connects the plunger concave wide ring groove (5) and the plunger upper wall (17) is an upper conical surface of plunger ring groove (6). One or a plurality of plunger oil inlet hole (7) distributed circumferentially are arranged on the plunger concave wide ring groove (5) or plunger upper wall (17), and there is a flanging (8) naturally formed by hole processing at the circumference of the plunger oil inlet hole (7). The plunger concave wide ring groove (5) is connected with the plunger oil inlet hole (7). The hydraulic medium enters to the plunger oil chamber (11)

from the outer ring groove of housing (14). A limit snap spring (20) is arranged between the plunger concave wide ring groove (5) and the inner ring groove of housing (10). A concave neck portion (15) is arranged at the lower end of the head portion (13) of the plunger (1), i.e. a first ring groove. The role of the neck portion (15) is to facilitate the installation of the card, through the reliable connection between the card and the roller rocker arm, it can prevent falling off.

Figure 2:
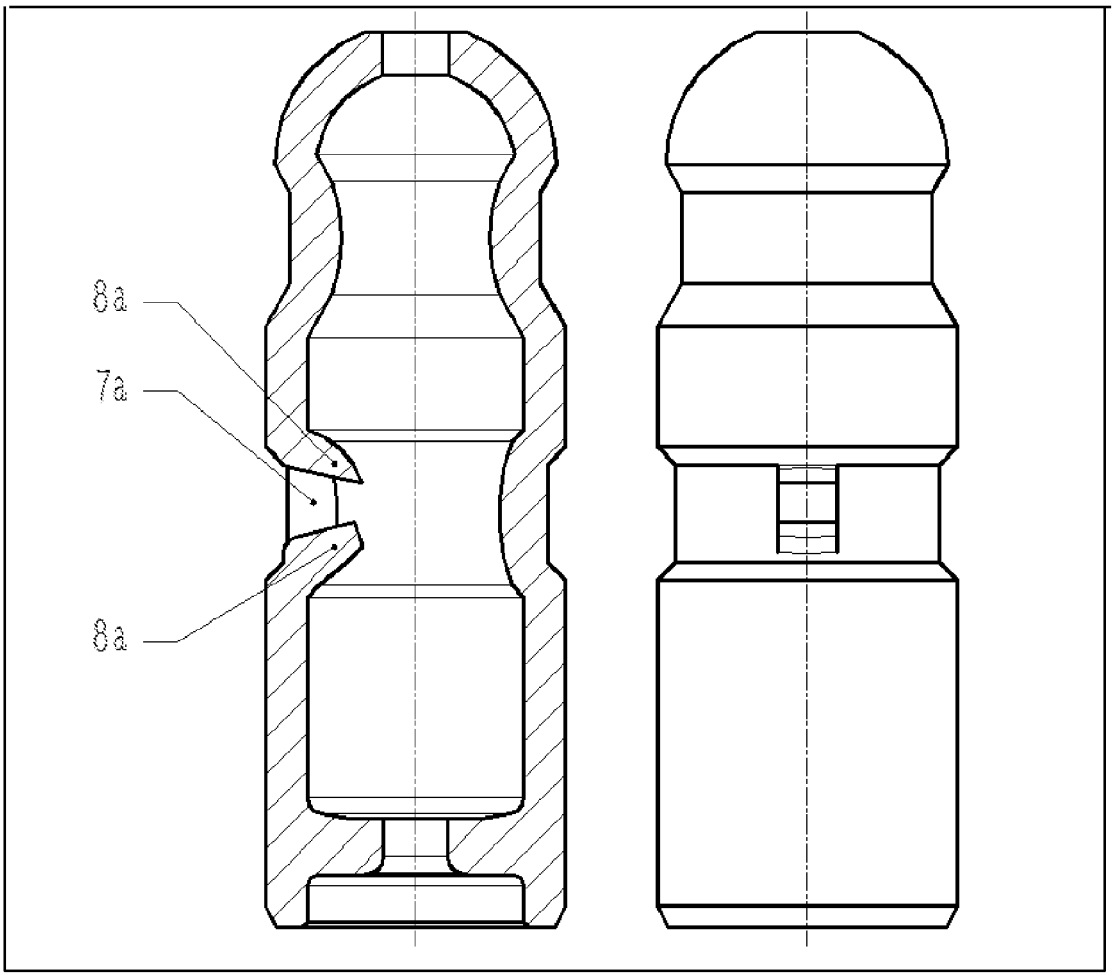
FIG. 2 is a schematic view of a plunger according to the specific embodiment 1 of the present invention.

Referring to FIG. 2, the plunger (1) is an integral structure, with the features of simple structure, excellent processing technology and convenience for assembly.

The plunger oil inlet hole (7*a*) is processed by a punch forming process in which the metal material flows into the cavity of the plunger to form a flanging of plunger oil inlet hole (8*a*). The process is simple, without generating wastes.

The plunger oil inlet hole (7*a*) is a bilateral "window-opening" structure, and the directions of window-opening are not limited to the vertical direction, which may include horizontal window-opening or double-sided window opening of other directions. The wall of window-opening hole may be a curved surface, not limited to a plane.

The plunger oil inlet hole (7*a*) is located on the plunger concave channel groove (5) or on the plunger upper wall (17), which should ensure that the width of the seal belt (14) formed by the upper boundary of the plunger oil inlet hole (7) and the first inner cylindrical wall of housing (18) is greater than 0.5 mm and the lower boundary of the plunger oil inlet hole (7*a*) is lower than the upper boundary of the upper conical surface of plunger ring groove (6).

EXAMPLE 2

Figure 3:
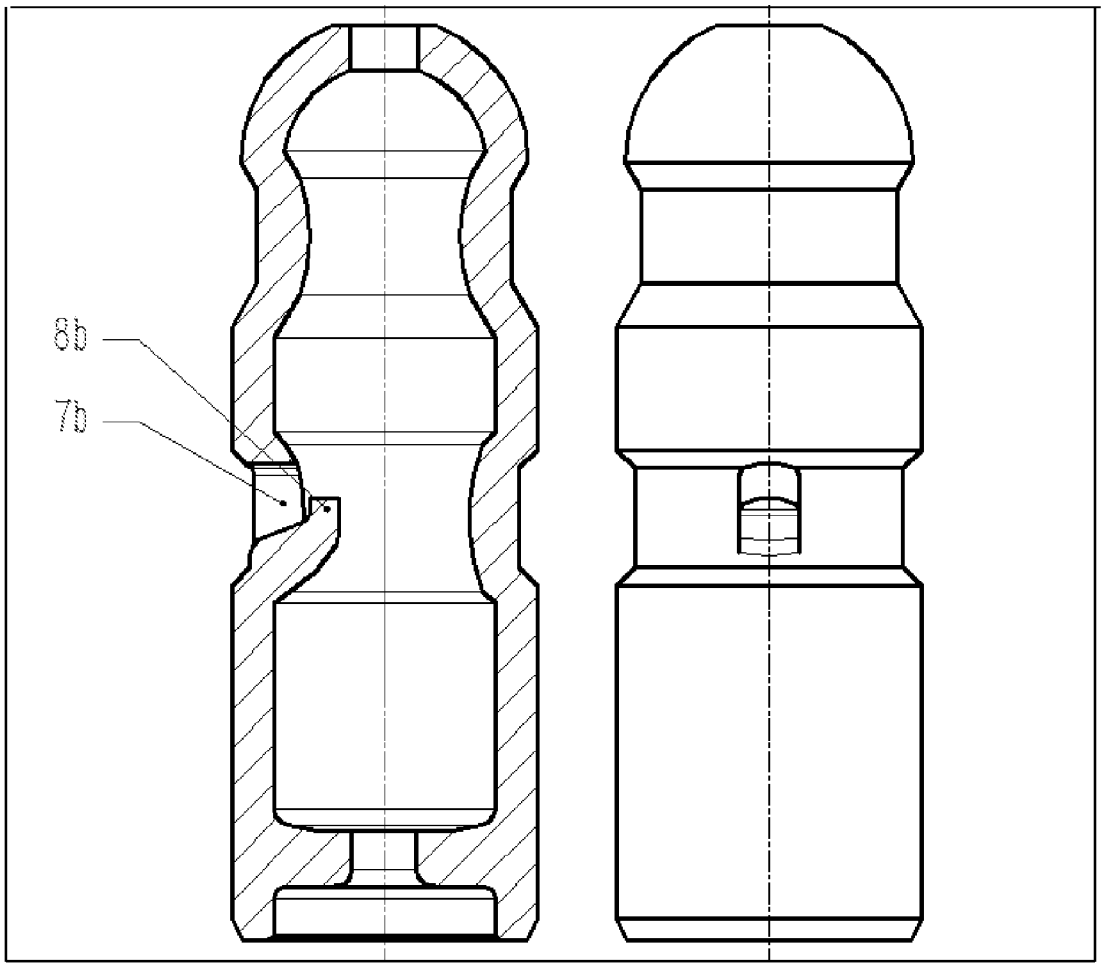
FIG. 3 is a schematic view of a plunger according to the specific embodiment 2 of the present invention.

Referring to FIG. 3, the difference from Example 1 is that, the plunger oil inlet hole (7*b*) is a unilateral window opening structure and the window-opening faces upwards.

EXAMPLE 3

Figure 4:
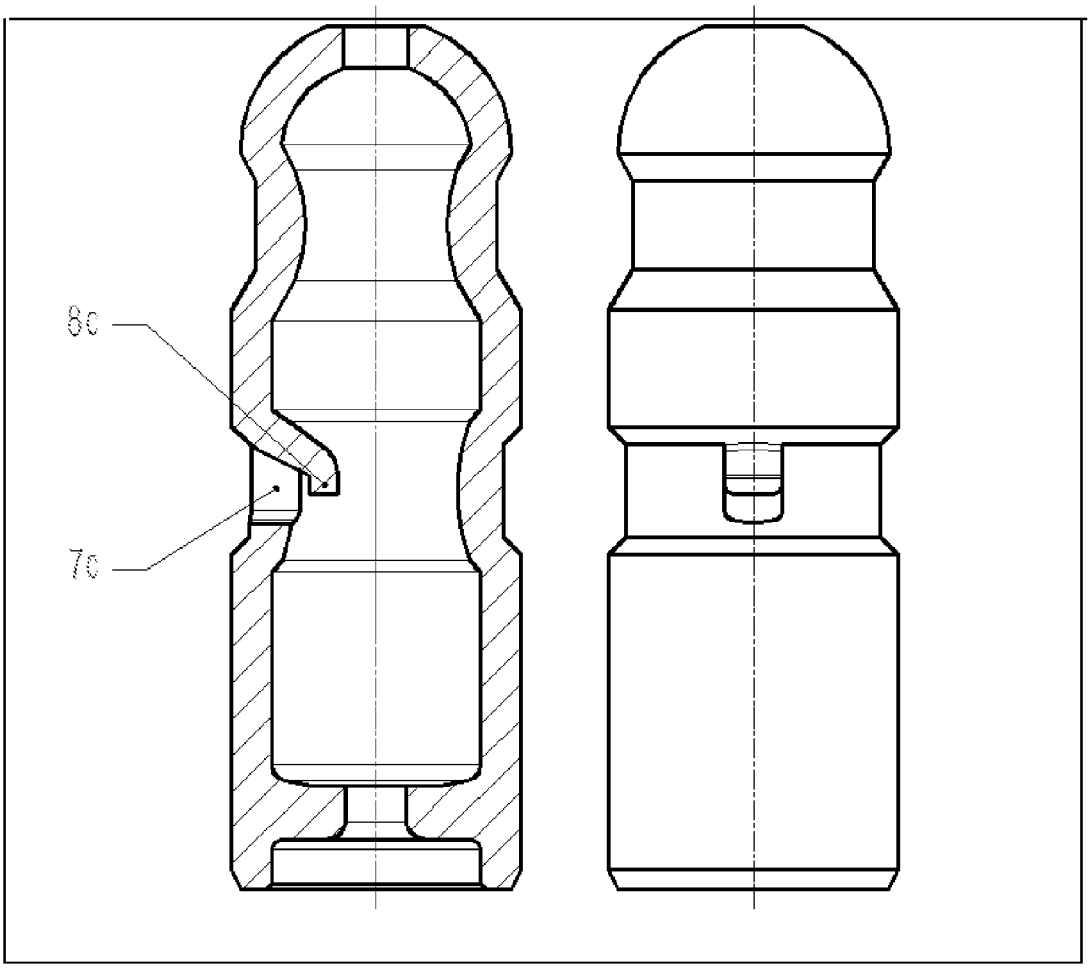
FIG. 4 is a schematic view of a plunger according to the specific embodiment 3 of the present invention.

Referring to FIG. 4, the difference from Example 1 is that, the plunger oil inlet hole (7*c*) is a unilateral window opening and the window-opening faces downwards.

EXAMPLE 4

Figure 5:
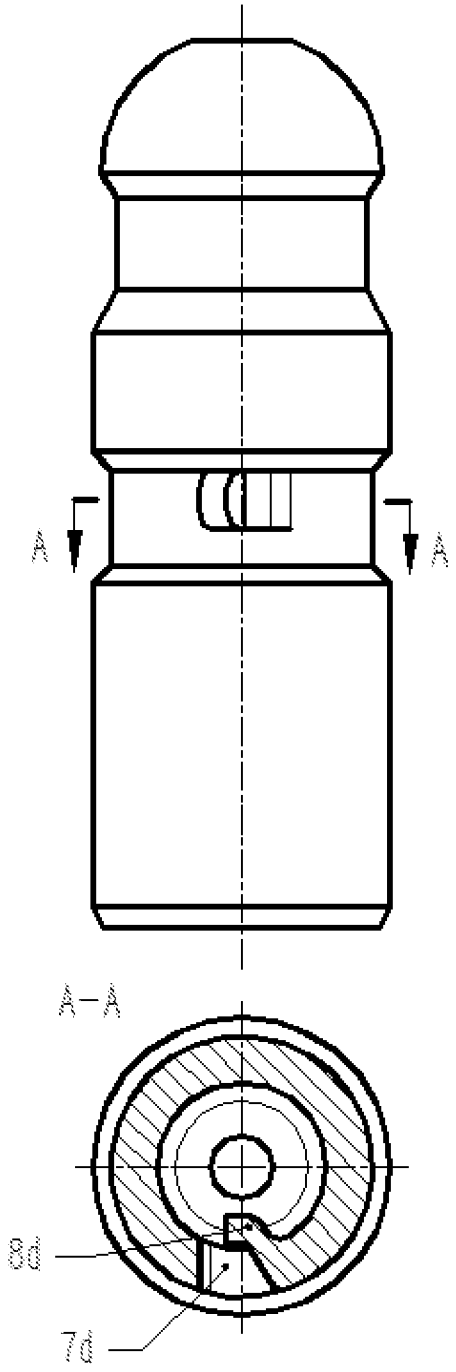
FIG. 5 is a schematic view of a plunger according to the specific embodiment 4 of the present invention.

Referring to FIG. 5, the difference from Example 1 is that, the plunger oil inlet hole (7*d*) is a unilateral window opening and the window-opening faces towards left or right direction.

EXAMPLE 5

Figure 6:
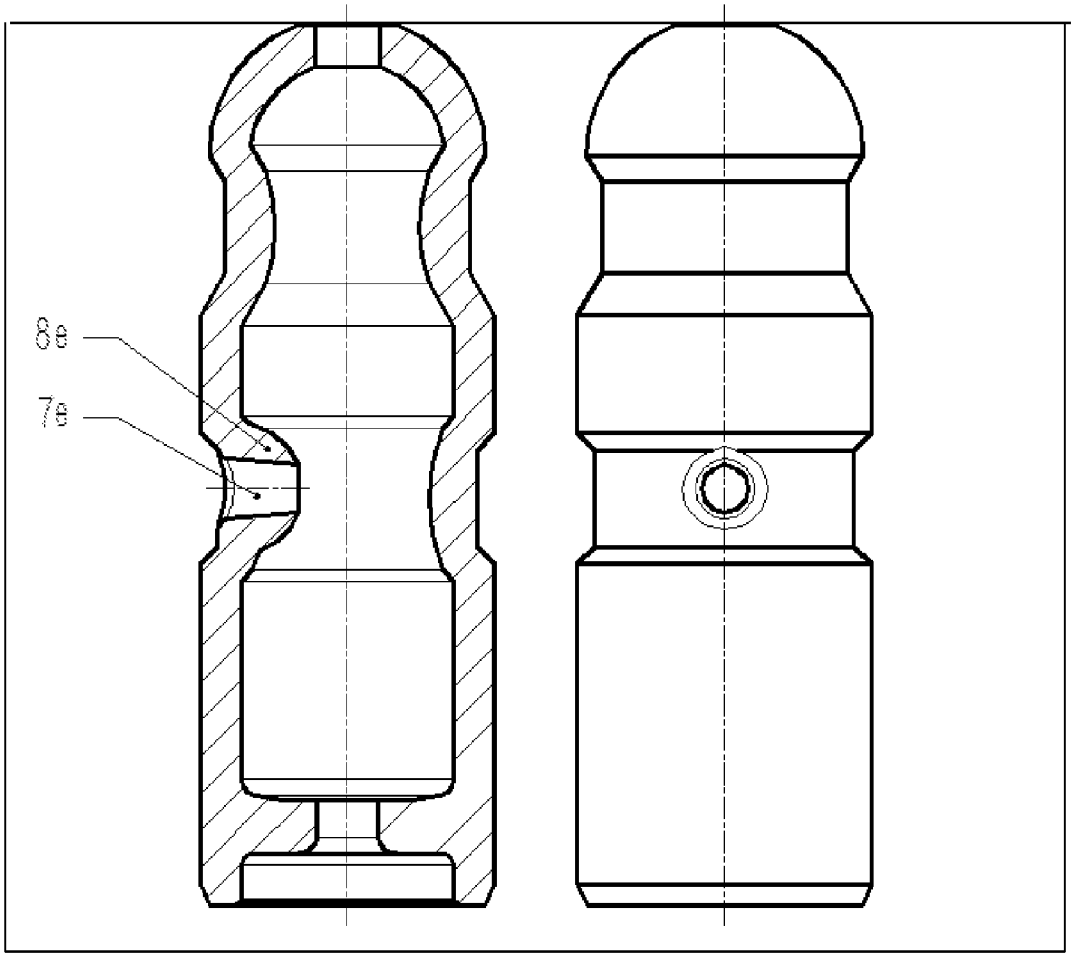
FIG. 6 is a schematic view of a plunger according to the specific embodiment 5 of the present invention.

Referring to FIG. 6, the difference from Example 1 is that, the plunger oil inlet hole (7*e*) is a conical structure, and the flanging of plunger oil inlet hole (8*e*) is naturally formed around the entire circumference of the plunger oil inlet hole (7*e*).

The above-described embodiments preferably adopt a bilateral window opening structure, which has the advantages of symmetrical force and long life of the molds compared with the unilateral window opening; in addition, its window-opening flow area is larger provided that the cross-sectional area of the mold is the same. Compared with a cone-shaped window-opening, it has a larger window-opening flow area provided that the cross-sectional area of the mold is the same.

What is claimed is:

1. A columnar-type hydraulic tappet, provided with a housing (2), a plunger (1) moving axially with respect to the housing (2) being mounted in an inner cavity of the housing, a high pressure cavity (12) used for a hydraulic medium extending between a lower end surface of the plunger and a lower side of the housing, the high pressure cavity (12) being sealed by a unidirectional valve (3) opened towards the high pressure cavity (12), an outer ring groove (14) used for hydraulic medium circulation being arranged on the outer diameter of the housing, an inner ring groove (10) used for hydraulic medium circulation being arranged at a radial inner side of the housing (2), one or a plurality of oil inlet holes (9) being arranged between the inner ring groove (10) and the outer ring groove (14), a first ring groove (15) being arranged below a head portion of the plunger (13), a second ring groove being arranged at a central portion of the plunger, a plunger central wall being between the first ring groove (15) and the second ring groove, the second ring groove being a concave wide ring groove, wherein at least one plunger oil inlet hole (7) being arranged on the plunger concave wide ring groove (5) or the plunger central wall, a plunger oil inlet hole (7) is processed by a punch forming process in which the metal material flows into the cavity of the plunger to form a flanging (8) of the plunger oil inlet hole, and a bottom portion edge of the plunger oil inlet hole containing the flanging (8) facing towards an inner cavity of the plunger (1).

2. The columnar-type hydraulic tappet according to claim 1, wherein the flanging (8) of the plunger oil inlet hole (7) is a non-fractured window-opening structure, and the flanging (8) that is naturally formed by the processing of plunger oil inlet hole (7) is attached to the bottom of oil inlet hole (7) of the inner cavity of the plunger (1).

3. The columnar-type hydraulic tappet according to claim 2, wherein the plunger oil inlet hole (7) has a unilateral window opening, and the flanging (8) is located on one side of the oil inlet hole of the plunger inner wall.

4. The columnar-type hydraulic tappet according to claim 2, wherein the plunger oil inlet hole (7*a*) has a bilateral window opening, and the flanging (8*a*) is located on both sides of the oil inlet hole (7*a*) of the plunger inner wall.

5. The columnar-type hydraulic tappet according to claim 1, wherein the plunger oil inlet hole (7*e*) is in a cone shape, and the plunger (1) is provided with a surrounding flanging (8*e*) connected to the plunger body (1) at the bottom of the plunger oil inlet hole (7*e*).

* * * * *